US006222147B1

(12) United States Patent
Doughty et al.

(10) Patent No.: US 6,222,147 B1
(45) Date of Patent: Apr. 24, 2001

(54) CIRCUIT BREAKER ARC EXHAUST BAFFLE WITH VARIABLE APERTURE

(75) Inventors: Dennis John Doughty, Plainville; Randall Lee Greenberg, Granby, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/522,027

(22) Filed: Mar. 9, 2000

(51) Int. Cl.[7] ..... H01H 33/02

(52) U.S. Cl. ..... 218/157; 335/201; 218/149

(58) Field of Search ..... 335/132, 201, 335/202; 218/156, 157, 34, 15, 35, 76, 81, 90, 149; 200/293–308

(56) References Cited

U.S. PATENT DOCUMENTS

| | | | | |
|---|---|---|---|---|
| 4,019,005 | * | 4/1977 | Michetti | 218/157 |
| 4,589,052 | | 5/1986 | Doughty . | |
| 4,631,376 | | 12/1986 | Leone . | |
| 4,639,564 | | 1/1987 | Grunert et al. . | |
| 4,650,940 | | 3/1987 | Grunert et al. . | |
| 4,728,914 | | 3/1988 | Morris et al. . | |
| 4,733,211 | | 3/1988 | Castonguay et al. . | |
| 4,833,563 | | 5/1989 | Russell . | |
| 4,928,080 | | 5/1990 | Jacobs et al. . | |
| 4,945,327 | * | 7/1990 | Doughty et al. | 335/201 |
| 5,196,817 | | 3/1993 | Jacobs et al. . | |
| 5,241,289 | | 8/1993 | Markowski et al. . | |
| 5,278,531 | | 1/1994 | Link et al. . | |
| 5,298,874 | | 3/1994 | Morel et al. . | |
| 5,304,761 | | 4/1994 | Rosen et al. . | |
| 5,569,894 | * | 10/1996 | Uchida et al. | 200/306 |
| 5,589,672 | * | 12/1996 | Uchida et al. | 218/34 |
| 5,753,878 | | 5/1998 | Doughty et al. . | |
| 5,767,440 | | 6/1998 | Byron et al. . | |
| 5,862,596 | | 1/1999 | Chung . | |
| 5,889,249 | * | 3/1999 | Rival et al. | 218/15 |

OTHER PUBLICATIONS

U.S. application No. #09/196,706, R.N. Castonguay, R.L. Greenberg, D.S. Christensen, "Circuit Breaker Mechanism for a Rotary Contact System", filed Nov. 20, 1998.

U.S. application No. #09/366,473, David Arnold, "Bottom Vented Circuit Breaker Capable of Top Down Assembly Onto Equipment", filed Aug. 3, 1999.

* cited by examiner

*Primary Examiner*—Lincoln Donovan
(74) *Attorney, Agent, or Firm*—Carl B. Horton

(57) ABSTRACT

An improved exhaust baffle for a circuit protective device such as a circuit breaker utilizes material having elastomeric characteristics to provide for variable apertures where the cross-sectional opening of the apertures is dependent on the pressure gradient across the exhaust baffle, thereby effectively controlling arc pressure and arc effluent during short circuit interruption. Fabrication of the exhaust baffle with geometric symmetry about one or more axes or planes also facilitates assembly during product construction.

12 Claims, 4 Drawing Sheets

CIRCUIT BREAKER ARC EXHAUST BAFFLE WITH VARIABLE APERTURE

BACKGROUND OF THE INVENTION

The present invention relates generally to the control of arc effluent from an electrical arc-extinguishing assembly (e.g., arc chute) typically used in electrical circuit protective devices such as circuit breakers, particularly industrial circuit breakers which require effective means for extinguishing both ac and dc electrical arcs. An industrial circuit breaker for ac or dc applications, however, is only one type of electrical device that would benefit from the present invention. Other types of electrical devices, such as; residential circuit breakers, commercial circuit breakers, current limiting circuit breakers, magnetic-only circuit breakers, double-break rotary circuit breakers, contactors, relays, switches, safety disconnects, motor starters, current limiting units, or any electrical device involving the creation, control and exhaust of electrical arc effluent, would benefit from the present invention, which has the primary function of controlling the exhaust effluent resulting from the generation of an electrical arc.

A primary function of an electrical circuit breaker is to disconnect a protected circuit from the power source when the electrical contacts are opened and there is an electrical arc drawn between the contacts. One such arcing condition occurs when there is a short circuit overcurrent, where the impedance of the load in the protected circuit is inadvertently bypassed or "shorted out", thereby permitting an abnormal excess of current to flow in the circuit breaker. Upon the occurrence of this short circuit overcurrent condition, a current sensing unit (e.g., trip unit) within the circuit breaker detects the overcurrent condition and signals the circuit breaker to open a set of electrical contacts to effectively disconnect the protected circuit from the power source. An operating mechanism within the circuit breaker operatively connects the current sensing unit to the electrical contacts for operating the electrical contacts from the closed position to the open position when a pre-established trip threshold is detected by the current sensing unit.

Upon the occurrence of a short circuit overcurrent, the rapid response of the trip unit and operating mechanism results in the rapid parting of the electrical contacts. However, due to the inductive nature of the power source and protected circuit, and the high rate of rise of the short circuit overcurrent, the overcurrent is not immediately extinguished. Instead, an electrical arc is drawn between and support by the parting contacts. As the electrical contacts continue to separate under the opening action of the operating mechanism, the electrical arc is lengthened and drawn into an arc chamber within the circuit breaker, whereby an arc extinguishing assembly is used to control and extinguish the electrical arc, thereby disconnecting the protected circuit from the power source. Within the arc extinguishing assembly is an arc exhaust baffle which effectively controls the arc effluent that is exhausted outside of the circuit breaker arc chamber.

Some industrial circuit breakers have short circuit withstand ratings, which is the ability of a circuit breaker to stay closed on a short circuit fault for a pre-established period of time without tripping or self-destructing. Due to the purposeful delay in the opening action of the circuit breaker contacts under a withstand condition, high peak let-through currents occur, which generally heats up the electrical conductors before the contacts open, thereby reducing the effectiveness of the contacts and associated electrical conductors to act as thermal conductors to extract heat from the arc once it is drawn. The short circuit withstand function of an industrial circuit breaker is generally employed on upstream circuit breakers which feed and protect multiple down stream circuits, thereby providing a downstream circuit breaker, which may be closer to the short circuit fault, with the first opportunity to clear the fault without inadvertently disconnecting large portions of a protected electrical distribution network.

Other industrial circuit breakers have no short circuit withstand ratings and are generally called upon to open the electrical contacts as quickly as possible when a short circuit trip condition occurs. Under this situation, the well known phenomena of asymmetrical current waveforms in a short circuit fault may result in the generation of higher powered electrical arcs than would occur if the short circuit fault current were symmetrical. Current limiting circuit breakers having "blow open" contact arms generally fall under this category of industrial circuit breakers.

Whether the circuit breaker has short circuit withstand ratings or not, the short circuit let through current (i.e., the electric current that flows in the circuit breaker upon the occurrence of a short circuit fault) can be of significant magnitude, resulting in an electrical arc (ac or dc depending on the application) which must be controlled and extinguished by the arc chute in the arc chamber of the circuit breaker, and arc effluent which must be controllably exhausted to the external surroundings.

Electrical arcs and arc effluent are not new to the circuit protective devices industry, and circuit breakers have successfully controlled them using large arc chutes having steel arc plates to magnetically attract the arc, break the arc up into arclets producing a plurality of anode-cathode drops, and ultimately extinguishing the arc and exhausting the arc effluent through sizable vent ports to the environment external of the circuit breaker, thereby disconnecting the protected circuit from the power source. However, such arc extinguishing assemblies typically employ vent baffles having vent openings of a fixed geometry that are called upon to work effectively at both low and high short circuit interruption levels. However, as the short circuit interruption levels increase, so the internal pressure of the arc chamber increases, but the cross-sectional area of the vent openings remain fixed, thereby limiting the efficient exhausting of arc effluent at high short circuit interruption levels.

Thus, it would be beneficial to have an arc extinguishing assembly that overcomes the shortcomings of a vent baffle having openings that are fixed in cross-sectional area. It would also be beneficial to have a vent baffle that has geometric symmetry about multiple planes for enhanced ease of assembly. Such an arc extinguishing assembly would be beneficial in standard type circuit breakers having a single contact gap, rotary type circuit breakers having more than one contact gap, other electrical circuit protective devices having an arc-extinguishing function, or any electrical device involving the creation, control, and extinguishing of an electrical arc and the exhausting of arc effluent.

SUMMARY OF THE INVENTION

In accordance with the present invention, a variable aperture exhaust baffle (exhaust baffle) is provided having vent openings with a cross-sectional area that is dependent on the gas pressure difference on either side of the exhaust baffle. Also provided is an exhaust baffle with geometric symmetry about one or more axes or planes. Further provided is an arc extinguishing assembly (e.g., arc chute) in fluid cooperation with the exhaust baffle of the present invention whereby the gaseous fluid passing through the arc chute also substantially passes through the exhaust baffle. Yet further provided is a circuit breaker having an arc chute in fluid cooperation with the exhaust baffle of the present invention.

The circuit breaker arc chute comprises electrically conductive magnetic arc splitter plates (arc plates) arranged generally parallel to one another, and support walls (arc plate supports) that both support the arc plates and electrically isolate them from one another, whereby the forward edge of each arc plate receives an electrical arc, the electrically isolated arc plates break the arc up into arclets that coexist between adjacent arc plates, and the rearward edge of each arc plate expels the individual arclets. An exhaust baffle, adjacent the rearward edge of the arc plates in the arc chute and retained by surface detail of the circuit breaker housing, is in fluid cooperation with the arc chute whereby the arc effluent passing through the arc chute also substantially passes through the exhaust baffle.

By fabricating the variable aperture exhaust baffle out of a material having elastomeric characteristics (for example, a material exhibiting the capability of recovering substantially in shape and size after removal of a deforming force, such as isoprene, chloroprene or silicone rubber, or metal or fiber board exposed to stresses not excessively beyond the material's elastic limit), the cross-sectional area of the vent openings within the exhaust baffle will vary depending on the gas pressure gradient across the exhaust baffle. Under low level short circuit conditions where the let through current is low, the electrical power within the arc will be low, thereby resulting in low arc pressure (i.e., arc pressure is a term used to describe the gas pressure resulting from the electrical power within the arc). Conversely, under high level short circuit conditions where the let through current is high, the electrical power within the arc will be high, thereby resulting in high arc pressure. High arc pressure is typically beneficial to arc interruption because it tends to constrict the arc and increase the arc resistance, thereby aiding in the suppression of the let through current and the eventual interruption of the arc. Since high arc pressure is advantageous for effective interruption of an electrical arc, but undesirable above a threshold level since structural damage to the surrounding circuit breaker housing may result, the variable aperture exhaust baffle effectively permits the retention of high arc pressure under low level short circuit conditions, and the expulsion of excess arc pressure under high level short circuit conditions, thereby providing advantageous arc pressure for effective interruption without the disadvantage of possible structural damage to the supporting housing.

Upon the occurrence of a short circuit overcurrent the trip unit detects the overcurrent condition and signals the mechanism to open the electrical contacts. As the electrical contacts part, so an electrical arc is drawn. As the heat of the arc impinges and ablates the surfaces of surrounding material, so the gas pressure inside the arc chamber of the circuit breaker increases. Further parting of the contacts lengthens the arc and exposes additional surrounding material to the ablative heat of the arc, further increasing the arc chamber gas pressure. Due to the electromagnetic influence of the arc plates, and the gas pressure differential between the inside of the arc chamber and the external environment, the arc is driven into the arc chute assembly where it is broken up into arclets that coexist between adjacent arc plates. The combination of the individual anode-cathode voltage drops of each arclet and the de-ionizing effect of ablated arc chamber material substantially increases the arc resistance resulting in eventual arc interruption. The arc effluent is eventually exhausted through vent openings in the variable aperture exhaust baffle.

With regard to circuit breakers employing "blow open" contact arms (such an arrangement is described in U.S. Pat. No. 4,733,211 entitled "Molded Case Circuit Breaker Crossbar Assembly"), an alternate tripping system (e.g. pressure-responsive trip system) may be employed to initiate a trip response in the operating mechanism. Such a pressure-responsive trip system is well known in the art and is fully described in U.S. Pat. No. 5,298,874 entitled "Range of Molded Case Low Voltage Circuit Breakers." Upon the occurrence of a short circuit overcurrent, the "blow open" contact arms are electrodynamically repelled away from a mating line strap typically before the conventional trip unit and mechanism can respond. The parting of the separable contacts produces an electric arc, thereby generating ionized gases and an increase in localized pressure, generally referred to as arc pressure. This arc pressure acts upon the pressure-responsive trip system to effectuate a trip action in the operating mechanism, thereby ensuring a complete trip response of the circuit breaker as a whole. The interruption of the electric arc follows a similar sequence as outlined above, where the arc effluent is eventually exhausted through vent openings in the variable aperture exhaust baffle. Thus, as can be readily seen, the variable aperture exhaust baffle is applicable to short circuit interruption devices employing a variety of tripping systems.

While the present invention is exemplified as being well suited for circuit breaker applications, it is also well suited for use in other devices involving the management and extinction of an electric arc, such as, for example, relays, contactors, motor control centers, switches and the like.

DESCRIPTION OF THE PREFERRED EMBODIMENT

Circuit Breaker Overview

Figure 1:
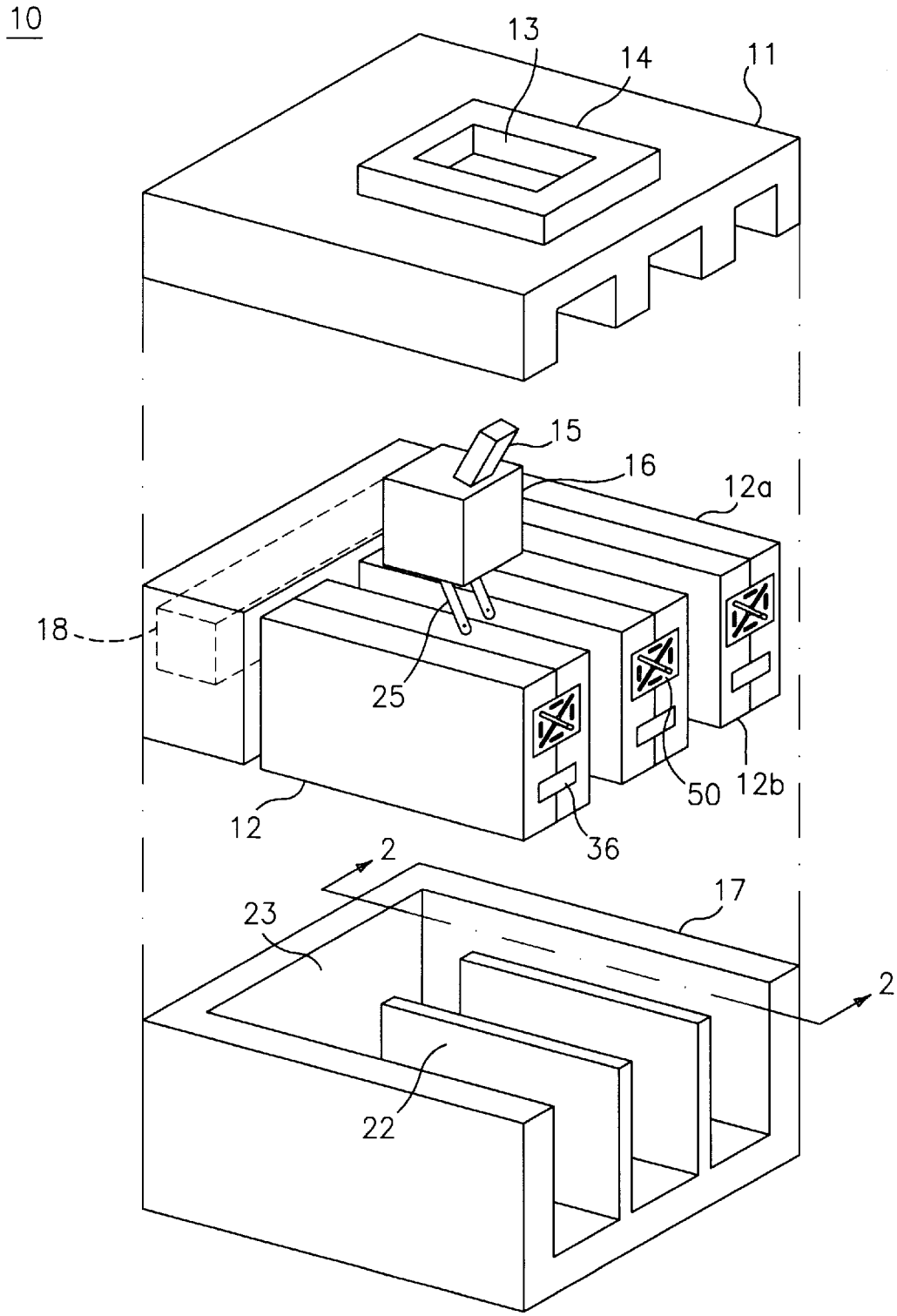
FIG. 1 illustrates an exploded isometric view of a circuit breaker incorporating the present invention.

A circuit breaker 10 incorporating the present invention is depicted in the exploded isometric view of FIG. 1. Cassette 12, conventional trip unit 18 and conventional operating mechanism 16, are captivated and substantially enclosed between cover 11 and base 17 by fasteners, not shown. Cassette halves 12*a,b* are secured by fasteners, not shown, and positionally located in pocket 22 of case 17. Trip unit 18 is positionally located in pocket 23 of case 17. Extending through opening 13 of escutcheon 14 on cover 11 is operating handle 15, which is operatively connected between operating mechanism 16 and movable contact arm 20 for opening and closing electrical contacts 21*a,b,c,d,* best seen by referring to FIG. 2.

Figure 2:
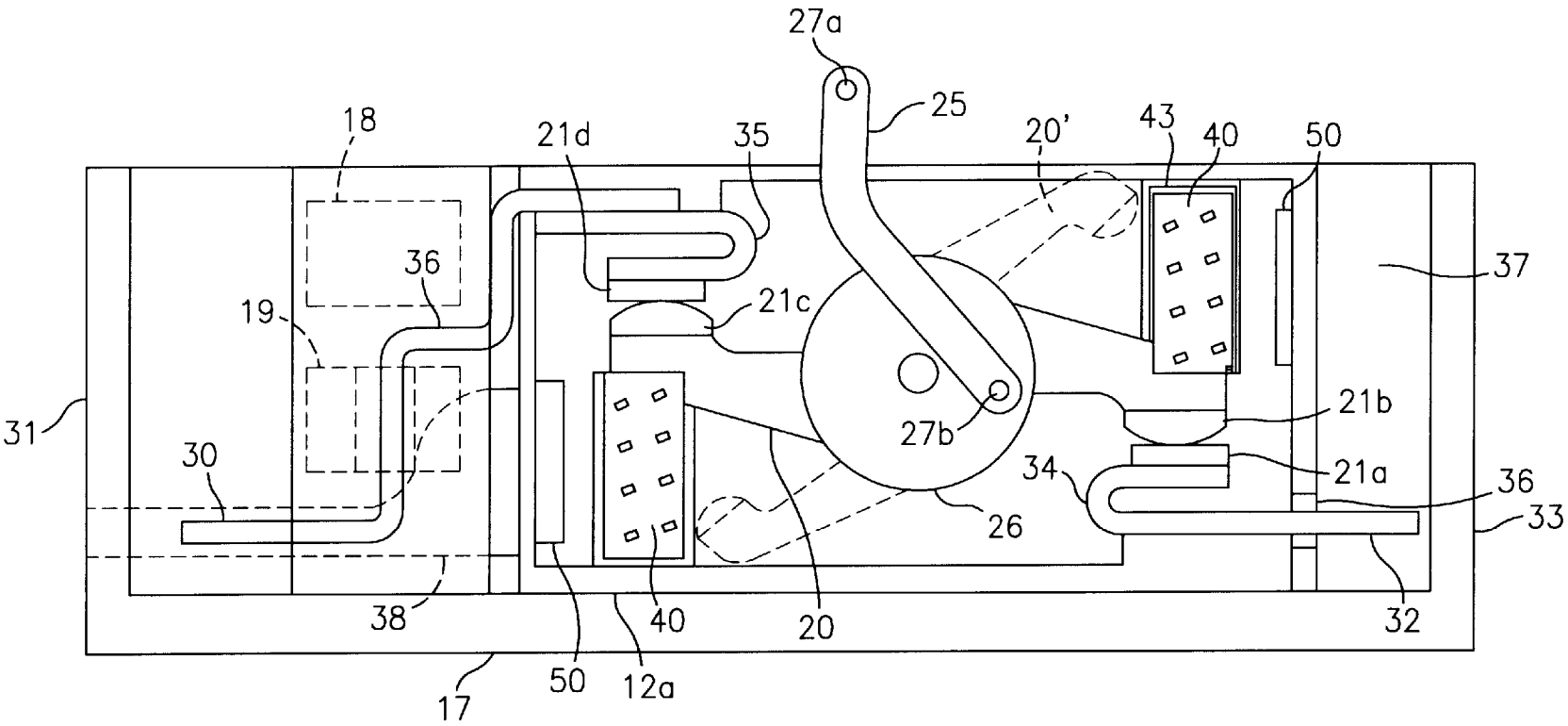
FIG. 2 illustrates a cut away view of a horizontally oriented circuit breaker incorporating the present invention.

A conventional operating mechanism 16, well known to one skilled in the art and depicted generally in FIG. 1, is fully described in commonly assigned U.S. patent application Ser. No. 09/196,706 entitled "Circuit Breaker Mechanism for a Rotary Contact System" filed Nov. 20, 1998, which is herein incorporated by reference. A conventional trip unit 18, depicted generally in FIG. 1 and in phantom in FIG. 2, is operatively connected between conventional current sensors 19, depicted in phantom in FIG. 2, and operating mechanism 16 to effectuate the opening of contacts 21*a,b,c,d* upon the occurrence of an abnormal overcurrent condition. A conventional trip unit 18 and conventional current sensors 19 are well known to one skilled in the art and are fully described in commonly assigned U.S. Pat. Nos. 4,589,052, 4,728,914, and 4,833,563, which are herein incorporated by reference.

Referring to FIG. 2, which depicts a cutaway side view of cassette 12 and trip unit 18 in case 17, electrical connections between the protected circuit, not shown, and circuit breaker 10 are made through load terminal 30 on load side 31 of circuit breaker 10. Electrical connections between the power source, not shown, and circuit breaker 10 are made through line terminal 32, shown in FIG. 2, on line side 33 of circuit breaker 10.

Referring to both FIGS. 1 and 2, circuit breaker 10 constructed in accordance with the present invention, includes operating handle 15 for driving operating mechanism 16 to manually open and close electrical contacts 21*a,b,c,d.* Contact 21*a* is carried by elongated fixed contact arm 34, contacts 21*b,c* are carried by elongated movable contact arm 20, and contact 21*d* is carried by elongated fixed contact arm 35. FIG. 2 also shows movable contact arm 20', depicted in phantom, following an opening action by trip unit 18 and operating mechanism 16. Fixed contact arm 34 extends through opening 36 of cassette 12 to terminate in line terminal 32. Obviously, each phase of the multi-phase circuit breaker would have separate conductors per phase, not shown. Operating mechanism 16 is operatively connected to contact arm 20 by link 25, rotor 26, and connecting pins 27*a,b.*

The current path through circuit breaker 10 in the closed position is best seen by referring to FIG. 2. Under quiescent operating conditions, the current from the power source enters circuit breaker 10 through line terminal 32 (and other line terminals on adjacent phases not shown), and exits through load terminal 30 (and other load terminals on adjacent phases not shown). Between line terminal 32, and load terminal 30, the current path consists of; fixed contact arm 34, electrical contacts 21*a* and *b*, movable contact arm 20, electrical contacts 21*c* and *d*, fixed contact arm 35, and sensor strap 36. Sensor strap 36 passes through and provides primary current signal to current sensor 19, which is operatively connected to trip unit 18. Fixed contact arm 35 is mechanically and electrically connected to sensor strap 36 by a fastener, not shown.

Arc Chute Chamber

Figure 3:
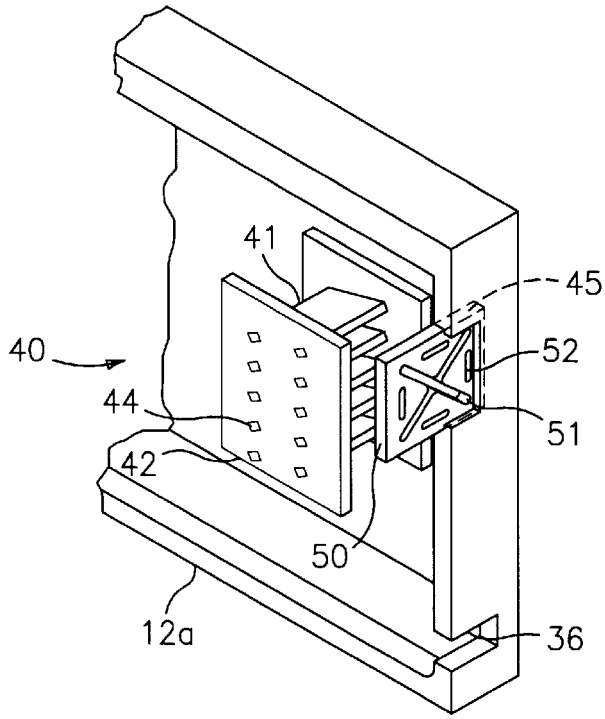
FIG. 3 illustrates a partial isometric view of a horizontally oriented arc chute chamber incorporating the present invention.

Arc chute assembly 40 is removably captivated within cassette 12 by molded detail 43 that is integral to cassette 12, and is best seen by now referring the FIGS. 2, and 3. Arc plates 41, are typically, but not necessarily, arranged substantially parallel to one another, have tabs 44 that are captivated in corresponding slots in plate supports 42. Variable aperture exhaust baffle 50, made from a material having elastomeric characteristics, is removably captivated within cassette 12 by molded slot 45, shown in phantom in FIG. 3, that is integral to cassette 12. An X-slot 51 and rectangular slots 52 are formed in exhaust baffle 50, thereby providing through holes in exhaust baffle 50 for the passage of arc effluent generated from a short circuit interruption condition. Since exhaust baffle 50 is made from an elastomeric material, or similar material having elastomeric characteristics, the sections of exhaust baffle 50 between X-slot 51 and rectangular slots 52 will elastically deflect according to the pressure gradient across exhaust baffle 50. The greater the pressure gradient, the greater the deflection. The arc effluent passing through exhaust baffle 50 on line side 33 of circuit breaker 10 will exit case 17 through terminal chamber 37. The arc effluent passing through exhaust baffle 50 on load side of circuit breaker 10 will exit case 17 through vent channel 38, shown in phantom in FIG. 2. Vent channels 38 are fully described in commonly assigned U.S. patent application Ser. No. 09/366,473 entitled "Bottom Vented Circuit Breaker Capable of Top Down Assembly Onto Equipment" filed Aug. 3, 1999, which is herein incorporated by reference.

Variable Aperture Exhaust Baffle

Figure 4:
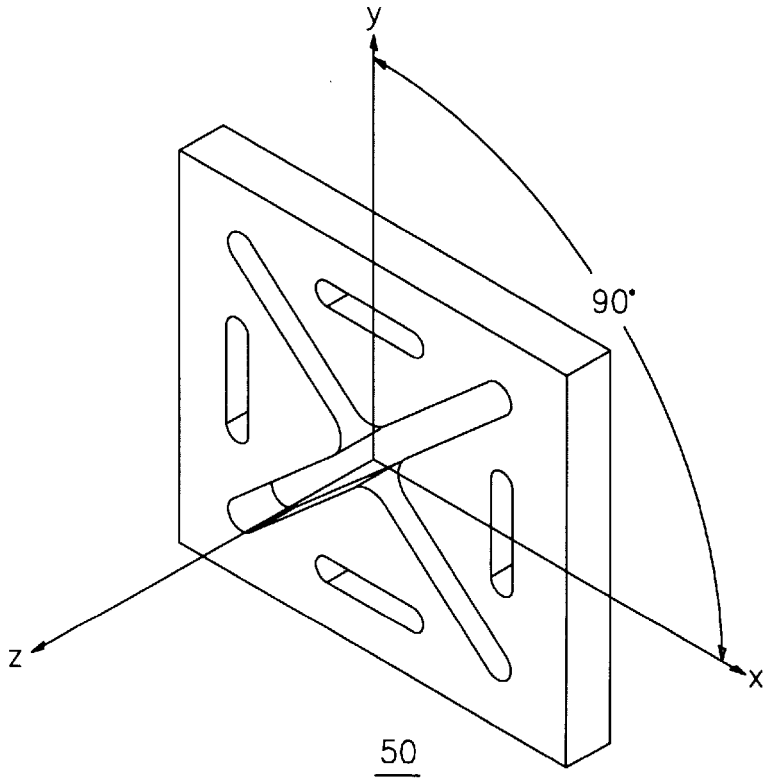
FIG. 4 illustrates an isometric view of a variable aperture exhaust baffle in accordance with the present invention.

Variable aperture exhaust baffle 50 is shown separately in isometric view in FIG. 4 with orthogonal x, y and z axes superimposed, where the origin of the x, y and z axes is in the material center of exhaust baffle 50. As can be seen, if exhaust baffle 50 is rotated 90 or 180 degrees either clockwise or counter-clockwise about the z-axis, the resulting geometry will be equivalent to the starting geometry. The same equivalent geometry will be achieved if exhaust baffle 50 is rotated 180 degrees about either the x-axis or y-axis. The equivalent geometry of exhaust baffle 50 at multiple angular orientations results in exhaust baffle 50 having the same effect on the arc effluent regardless of the assembled orientation of exhaust baffle 50 in cassette 12 or arc chute assembly 60. Since the arc gas flow within arc chute assemblies 40 and 60 is typically non-uniform, the ability to assemble exhaust baffle 50 at multiple angular orientations with substantially no effect on the arc effluent greatly facilitates assembly of exhaust baffle 50 in cassette 12 or in arc chute assembly 60, thereby simplifying robotic or non-manual assembly.

Figure 6:
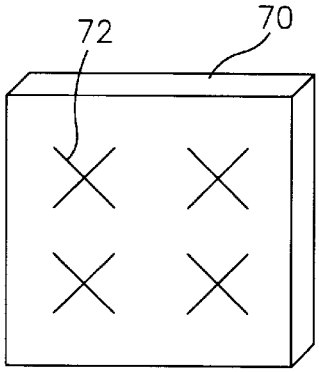
FIGS. 6 through 9 illustrate isometric views of alternate embodiments of the variable aperture exhaust baffle of FIG. 4 in accordance with the present invention.
Figure 7:
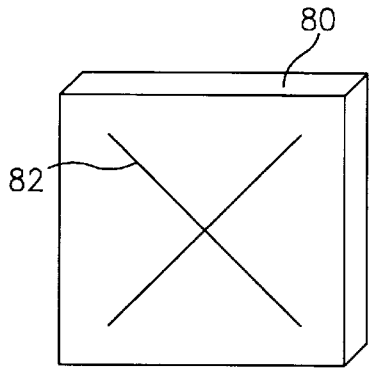
Figure 8:
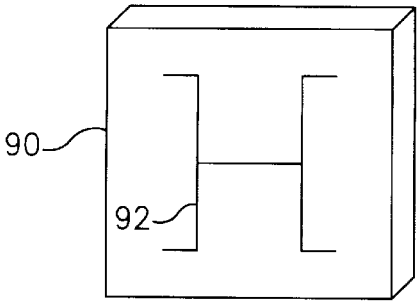
Figure 9:
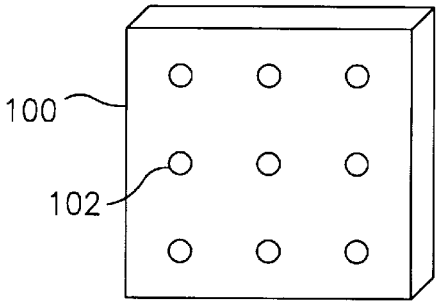

While only one arrangement of slots in exhaust baffle 50 resulting in multi-axis and multi-plane symmetry are herein described, the reader will appreciate that many other arrangements of slots, or holes, are possible that would result in the equivalent benefits of the present invention. For example, FIG. 6 shows an alternate embodiment exhaust baffle 70 with four cuts 72 (as opposed to slots or holes) each in the shape of an "X". Due to the pliant nature of the elastomeric-like material of exhaust baffle 70, the central portions of each "X" cut will flex in the direction of decreasing pressure gradient, thereby producing an arrangement of apertures in exhaust baffle 70 having multi-axis symmetry where the resulting through openings of the membrane of exhaust baffle 70 are variably dependent on the pressure gradient across the membrane. As a further example of an alternate embodiment to exhaust baffle 50, FIG. 7 shows alternate exhaust baffle 80 made from a metallic (for example, spring steel) or insulating (for example, fiber board) material that has spring-like or elastomeric-like characteristics, whereby cut 82 in the shape of an "X" provides the means for producing a variable aperture exhaust baffle 80 in response to a pressure gradient across exhaust baffle 80. Yet a further example of an alternate embodiment to exhaust baffle 50 is shown in FIG. 8, where alternate exhaust baffle 90 made from metallic, insulating or elastomeric material has cut 92 in the shape of an "H" to provide the means for producing a variable aperture exhaust baffle 90 in response to a pressure gradient across exhaust baffle 90. An even further example of an alternate embodiment to exhaust baffle 50 is shown in FIG. 9, where alternate exhaust baffle 100, made from elastomeric material, has holes 102 which stretch (in the direction of decreasing pressure) to a larger diameter when exposed to an impressed pressure gradient across exhaust baffle 100, and then substantially recover to their original size upon the removal of the impressed pressure gradient, thereby providing for a variable aperture exhaust baffle.

FIGS. 4, 6–8, show exemplary and alternate embodiments of the present invention, and while some figures are described as being fabricated from a particular material, one skilled in the art will appreciate that any of the noted configurations can be fabricated from any of the materials described (spring-like or elastomeric-like). The choice of material is typically based on the design specifications associated with the performance requirements of the device. A high interruption performance requirement would typically require the use of a high temperature material such as thermoset elastomer (high power arcs produce intense heat and high temperature arc effluent). Conversely, a low interruption performance requirement would typically not require the use of a high temperature material and therefore fiber board may be suitable for the application. Also factoring into the material selection for the membrane is the magnitude of the impressed pressure gradient across the membrane. The higher the pressure gradient across the membrane, the greater the degree of resiliency the membrane material should have, thereby enabling the membrane to deform without exceeding the material elastic limit. Thus, for high pressure arcs, a highly resilient elastomer material may be the designer's material of choice. Conversely, for low pressure arcs, a low resilient fiber board material may be the designer's material of choice. Alternatively, for low pressure arcs having a high temperature, a low resilient but high temperature spring steel material may be the designer's material of choice.

The resilient nature of the elastomeric-like material provides for a flexible membrane with through openings whereby an impressed pressure gradient across the membrane causes a change in shape of the membrane to increase the size of the through openings, and removal of the impressed pressure gradient across the membrane results in a substantial recovery of the original shape of the membrane, thereby producing a variable aperture exhaust baffle where the size of the variable aperture is dependent on the impressed pressure gradient.

A variable aperture exhaust baffle made from a flexible membrane and having geometric symmetry about one or more axes will have equivalent geometry at both a first and a second angular orientation. For example, taking the angular orientation of exhaust baffle 50 as depicted in FIG. 4 as being zero degrees, the same geometric structure would result if exhaust baffle 50 was rotated 90, 180 or 270 degrees about the z-axis, 180 degrees about the x-axis, or 180 degrees about the y-axis. The advantage of such an arrangement can be readily seen where robotic or non-manual assembly is desired.

Alternate Embodiment

Figure 5:
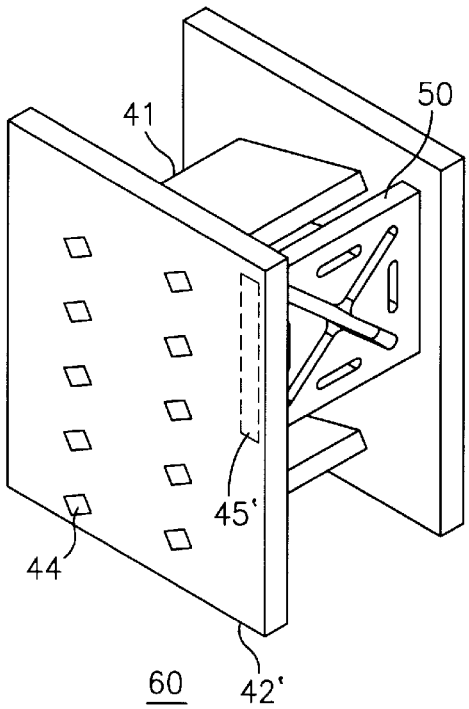
FIG. 5 illustrates an isometric view of an alternate embodiment of an arc chute assembly incorporating the present invention.

Arc chute assembly 60 depicted in FIG. 5 shows an alternate embodiment of the present invention. Tabs 44 on arc plates 41 are captivated in corresponding slots in plate supports 42' in a similar manner as described above. However, instead of exhaust baffle 50 being captivated in slots 45 of cassette 12 as described above and shown in FIG. 3, exhaust baffle 50 is captivated in slots 45' in plate supports 42', thereby providing an arc chute and exhaust baffle subassembly.

What is claimed is:

1. A variable aperture exhaust baffle comprising:

a flexible membrane having at least one opening; said at least one opening having a first opening size at a first pressure gradient across said membrane and a second opening size at a second pressure gradient across said membrane;

said flexible membrane having a first geometry at a first angular orientation, a second geometry at a second angular orientation, and wherein, said first geometry and said second geometry being the same with said first geometry at said first angular orientation and said second geometry at said second angular orientation are each geometrically symmetrical about the same plane.

2. The exhaust baffle of claim 1 wherein said flexible membrane is planar.

3. The exhaust baffle of claim 1 wherein said flexible membrane comprises a material having elastomeric characteristics.

4. An electrical arc extinguishing assembly comprising:

at least one electrically conductive magnetic arc splitter plate;

a variable aperture exhaust baffle;

at least two opposing side walls of electrical insulating material for supporting said at least one arc splitter plate and said exhaust baffle; and said variable aperture exhaust baffle comprising a flexible membrane having at least one opening, said at least one opening having a first opening size at a first pressure gradient across said membrane and a second opening size at a second pressure gradient across said membrane, said flexible membrane having a first geometry at a first angular orientation, a second geometry at a second angular orientation, and wherein said first geometry and said second geometry being the same with said first geometry at said first angular orientation and said second geometry at said second angular orientation are each geometrically symmetrical about the same plane.

5. The electrical arc extinguishing assembly of claim 4 wherein said flexible membrane is planar.

6. The electrical arc extinguishing assembly of claim 4 wherein said flexible membrane comprises an a material having elastomeric characteristics.

7. A molded case circuit breaker comprising:

at least one pair of electrical contacts for making and breaking an electrical current and for supporting an electrical arc therebetween;

a means for mechanically and electrically connecting said circuit breaker to a power source;

a means for mechanically and electrically connecting said circuit breaker to a protected circuit;

at least one contact arm disposed between said power source connecting means and said protected circuit connecting means for moving said at least one pair of electrical contacts;

a trip unit operatively connected to said protected circuit connecting means for transmitting a signal to initiate a trip action to open said at least one pair of electrical contacts upon the existence of an overcurrent condition;

an operating mechanism operatively connected to said trip unit and said at least one contact arm for responding to said signal from said trip unit to open said at least one pair of electrical contacts when an overcurrent condition exists;

an arc extinguishing assembly for extinguishing an electrical arc drawn between said at least one pair of electrical contacts as said at least one pair of electrical contacts open due to the trip action initiated by said trip unit;

a variable aperture exhaust baffle;

a case for partially enclosing and supporting said circuit breaker components;

a cover connecting to said case for substantially completing the enclosure of said circuit breaker components;

an operating handle operatively connected to said operating mechanism and extending through said cover for manually operating said at least on pair of electrical contacts between an open and closed position; and said variable aperture exhaust baffle comprising a flexible membrane having at least one opening, said at least one opening having a first opening size at a first pressure gradient across said membrane and a second opening size at a second pressure gradient across said membrane, said flexible membrane having a first geometry at a first angular orientation, a second geometry at a second angular orientation, and wherein said first geometry and said second geometry being the same with said first geometry at said first angular orientation and said second geometry at said second angular orientation are each geometrically symmetrical about the same plane.

8. The molded case circuit breaker of claim 7 wherein said flexible membrane is planar.

9. The molded case circuit breaker of claim 7 wherein said flexible membrane comprises a material having elastomeric characteristics.

10. The exhaust baffle of claim 3 wherein said elastomer further comprises a thermoset elastomer.

11. The exhaust baffle of claim 3 wherein said elastomer is selected from the group consisting of isoprene, chloroprene and silicone rubber.

12. The exhaust baffle of claim 1 wherein said flexible membrane is selected from the group consisting of spring steel and fiber board.

* * * * *